United States Patent [19]

Marquardt et al.

[11] Patent Number: 4,786,433

[45] Date of Patent: Nov. 22, 1988

[54] METHOD OF PREPARING PHOSPHOROUS-FREE STABLE DETERGENT EMULSION

[75] Inventors: Linda L. Marquardt, Woodbury; Cheryl A. Hall, Plymouth, both of Minn.

[73] Assignee: Ecolab Inc., St. Paul, Minn.

[21] Appl. No.: 881,088

[22] Filed: Jul. 2, 1986

[51] Int. Cl.[4] ..... C11D 17/00

[52] U.S. Cl. ..... 252/174.24; 252/174.21; 252/135; 252/156; 252/DIG. 2; 252/DIG. 14

[58] Field of Search ..... 252/174.23, 90, 92, 252/134, 135, 174.24, 156; 134/36

[56] References Cited

U.S. PATENT DOCUMENTS

| | | | |
|---|---|---|---|
| 3,075,922 | 1/1963 | Wixon | 252/138 |
| 3,308,067 | 3/1967 | Diehl | 252/161 |
| 4,286,956 | 9/1981 | Bechstedt . | |
| 4,288,225 | 9/1981 | Roland et al. . | |
| 4,388,205 | 6/1983 | Stettler et al. | 252/135 |
| 4,521,332 | 6/1985 | Milora | 252/527 |
| 4,569,781 | 2/1986 | Fernholz | 252/134 |

*Primary Examiner*—Josephine Barr

*Attorney, Agent, or Firm*—Merchant, Gould, Smith, Edell, Welter & Schmidt

[57] ABSTRACT

A method of manufacturing a stable, phosphorous-free alkaline detergent emulsion comprising the steps of (a) blending about 0.1 to 10 wt-% hardness sequestering organic polyelectrolyte having pendent carboxyl groups, about 5 to 40 wt-% nonionic surfactant, and about 1 to 10 wt-% water to form a pre-mix; (b) blending about 5 to 60 wt-% of a 40 to 60 wt-% first caustic solution and the pre-mix to form a first intermediate mixture; (c) blending about 1 to 10 wt-% of an acrylic resin and the first intermediate mixture to form a second intermediate mixture; and (d) blending about 10 to 50 wt-% of a 40 to 60 wt-% second caustic solution to form a detergent emulsion having a viscosity of about 250 to 1000 centipoise at 70° F.

The method may optionally include the step of blending the detergent emulsion in a high shear mixer.

20 Claims, No Drawings

METHOD OF PREPARING PHOSPHOROUS-FREE STABLE DETERGENT EMULSION

FIELD OF THE INVENTION

The invention relates to alkaline detergent emulsions. More specifically, the invention relates to storage stable, phosphorous-free, highly alkaline detergent emulsions.

BACKGROUND OF THE INVENTION

Alkaline detergents, particularly those intended for institutional and commercial use, generally contain phosphates as an effective hardness sequestrant. Due to adverse ecological effects created by phosphates which are released into our waterways, phosphate free detergents have been developed. One of these phosphate free detergents employs nitrilotriacetic acid (NTA) as an effective hardness sequestrant. However, NTA is now believed to be a carcinogen and its use has understandably been curtailed.

Accordingly, a need exists for a stable, phosphorous-free, NTA-free, built detergent composition capable of easily being dispensed.

SUMMARY OF THE INVENTION

A method of manufacturing an effective, stable, phosphorous-free built detergent emulsion comprising the steps of (a) blending about 0.1 to 10 wt-% phosphorous-free polyelectrolyte, about 5 to 40 wt-% nonionic surfactant, and about 1 to 10 wt-% water, based upon the detergent emulsion, to form a pre-mix; (b) blending about 5 to 60 wt-%, based upon the detergent emulsion, of a 40 to 60 wt-% first caustic solution and the pre-mix to form a first intermediate mixture; (c) blending a viscosity modifying and emulsion stabilizing amount of an acrylic resin and the first intermediate mixture to form a second intermediate mixture; and (d) blending about 10 to 50 wt-%, based upon the detergent emulsion, of a 40 to 60 wt-% second caustic solution to form a detergent emulsion having a viscosity of about 250 to 1000 cps at 70° F.

The method may also include the step of blending the detergent emulsion in a high shear mixer.

Unless otherwise specified all percentages will be wt-% based upon the detergent emulsion.

DETAILED DISCUSSION OF THE INVENTION INCLUDING A BEST MODE

I have discovered a method of making a storage stable, phosphorous-free, highly alkaline built detergent emulsion comprising water, a caustic material, a polycarboxylate polymer, a nonionic surfactant, and an acrylic resin.

The method comprises the steps of (a) blending about 0.1 to 10 wt-%, preferably about 4 to 8 wt-% of a polycarboxylate polymer, about 5 to 40 wt-%, preferably about 10 to 15 wt-%, nonionic surfactant, and about 1 to 10 wt-%, preferably about 6 to 10 wt-%, water, to form a pre-mix; (b) blending about 5 to 60 wt-%, preferably about 25 to 45 wt-%, of a 40 to 60 wt-% first caustic solution which has been heated to allow effective blending and the pre-mix to form a first intermediate mixture; (c) blending a viscosity modifying and emulsion stabilizing amount, preferably about 1.5 to 3.5 wt-%, of an acrylic resin and the first intermediate mixture to form a second intermediate mixture; and (d) blending about 10 to 50 wt-%, preferably about 30 to 40 wt-%, of a 40 to 60 wt-% second caustic solution which has been heated to allow effective blending and the second intermediate mixture to form a storage stable detergent emulsion.

The method may also include the step of processing the detergent emulsion through a high shear mixer such as a Tekmar® processor available from Tekmar Corporation. When employed, the emulsion is preferably circulated through the processor about 1 to 5 passes.

Minor amounts of other commonly employed detergent additives such as optical brighteners, dyes, antioxidants, fragrances, etc. may be added to the detergent emulsion by blending them in the pre-mix.

To facilitate blending, the first caustic solution is preferably heated to about 100° to 160° F. and the mixture maintained at a temperature of about 140° to 180° F. throughout the process. Each of the components added may be pre-heated prior to blending to assist in maintaining the desired temperature. Failure to keep the mixture heated results in a large increase in viscosity which results in a non-uniform, lumpy product. We have discovered that an exothermic reaction created by blending of the caustic material and the polycarboxylate polymer may increase the temperature of the first intermediate mixture above the desired limit and cooling may be necessary.

Blending of the first caustic solution and pre-mix may be done by either adding the first caustic solution to the pre-mix or by adding the pre-mix to the first caustic solution. Under either option addition should be done slowly and the mixture constantly agitated to prevent formation of lumps and/or complete separation of phases. The necessary rate of agitation is highly dependent upon the viscosity of the mixture, with an increase in agitation required for an increase in viscosity. We have discovered that the addition of the first caustic solution to the pre-mix allows the process to be conducted with fewer mixing vessels as a separate vessel is not required solely to mix the pre-mix but may also be used as the main mix tank. However, we have also discovered that addition of the pre-mix to the first caustic solution appears to result in a slightly more stable emulsion.

A list of caustic materials suitable for use in the first and second caustic solutions includes but is not limited to alkali metal hydroxides, alkali metal silicates, and alkali metal carbonates. For reasons of low cost, ease of availability, and high alkalinity the preferred caustic materials are alkali metal hydroxides, with sodium hydroxide being the most preferred. For ease of processing the first and second caustic solutions are preferably exactly the same such that they may be obtained from a single storage vessel.

A list of polycarboxylate compounds which may be usefully employed in the present invention as the phosphorous-free polyelectrolyte includes but is not limited to water soluble salts of polymaleic acid, polyitaconic acid, polymesaconic acid, polyfumaric acid, polyaconitic acid, copolymers of methylene and malonic acids, polycitraconic acid, polyethylfumarate, polyitaconic anhydride, copolymers of itaconic and aconitic acids, copolymers of itaconic and maleic acids, copolymers of mesaconic and fumaric acids, copolymers of methylene and malonic and citraconic acids, copolymers of ethylene and itaconic acids, copolymers of propylene and maleic acids, copolymers of acrylic and itaconic acids, copolymers of 3-butenoic and maleic acids, copolymers of isocrotonic and citraconic acids, copolymers of methacrylic and aconitic acids, copolymers of 4-pentenoic and itaconic acids, copolymers of ethylene and maleic anhydride, copolymers of methyl acrylate and ethyl fumarate, copolymers of ethyl aconitrate and ethyl itaconate, and copolymers of acrylonitrile and butyl maleate. For reasons of availability and dispersibility the preferred polycarboxylate polymer is a copolymer of acrylic and itaconic acids having a molecular weight of between about 5,000 and 15,000.

Any of the nonionic surfactants commonly employed in detergent compositions may be utilized in the present invention. A non-limiting list of such nonionic surfactants includes polyoxyethylenes, ethoxylated alkylphenols, ethoxylated aliphatic alcohols, carboxylic esters, carboxylic amides, polyoxyethylene fatty acid amides, and polyalkylene oxide block copolymers. A more complete list of nonionic surfactants, including a discussion of their detersive function, can be found in *Kirk-Othmer Encyclopedia of Chemical Technology,* 2d Ed., Vol. 19, pp. 531–554. For reasons of effective detersiveness, low cost and ease of availability the preferred nonionic surfactants are ethoxylated nonylphenol having 6–10 moles of ethoxylate and $C_{12-15}$ alcohols having 5–7 moles of ethoxylate.

An acrylic resin is employed to increase the viscosity of the emulsion. Preferably, an acrylic resin is chosen which can also function as a sequestrant and/or anti-redeposition agent. The preferred acrylic resin is polyacrylic acid having a molecular weight of about 2,000 to 8,000. The amount of acrylic resin should be sufficient to ensure a stable emulsion but not such as to significantly impede the pumpability of the emulsion. The viscosity of the emulsion should be about 250 to 1,000 cps at 70° F.

Calculating wt-% water as including all water however incorporated into the emulsion, and the wt-% of all other components as including only the component itself and not the water in which it is dissolved, the resultant detergent emulsion can comprise about 10 to 60 wt-% water, about 20 to 45 wt-% caustic material, about 0.1 to 10 wt-% polycarboxylate polymer, about 5 to 40 wt-% nonionic surfactant, and about 1 to 10 wt-% acrylic resin. Preferably, the detergent emulsion comprises about 40 to 50 wt-% water, about 25 to 45 wt-% caustic material, about 4 to 8 wt-% polycarboxylate polymer, about 10 to 20 wt-% nonionic surfactant, and about 1.5 to 3.5 wt-% acrylic resin.

EXAMPLE I

Into a 500 gallon vessel equipped with a turbine propeller, a steam jacket and a cooling water jacket was placed 2,100 lbs. of 50 wt-% sodium hydroxide solution and 149.5 lbs. of soft water to form a first caustic solution. The first caustic solution was heated to 120° F. and agitated by the turbine propeller rotating at 80 r.p.m. Into a separate 150 gallon vessel was blended 720 lbs. of a copolymer of acrylic acid and itaconic acid having a molecular weight of about 10,000 and manufactured by Economics Laboratory, 461 lbs. of NPE-9.5, a nonylphenoxy ethoxylate having 9–10 moles of ethoxylate manufactured by Economics Laboratory, 223 lbs. of NPE-6.5, a nonylphenoxy ethoxylate having 6–7 moles of ethoxylate manufactured by Economics Laboratory, 2.95 lbs. of Tinopal CBS-X, a distyryl biphenyl derivative useful as an optical brightener manufactured by Ciba-Geigy, and 3.54 lbs. of a 1.1 wt-% aqueous solution of Sandogran Blue 2GLS, a blue dye manufactured by Sandoz, to form a pre-mix. The pre-mix was agitated for 15 minutes. The pre-mix was slowly added to the first caustic solution with the resultant first intermediate mixture agitated for 20 minutes at 95 r.p.m. The temperature of the first intermediate mixture rose to 185° F. due to exothermic reaction between the sodium hydroxide and the acrylic acid/itaconic acid copolymer, at which time the cooling system was turned on to maintain the temperature below 190° F. 321 lbs. of a polyacrylic acid having a molecular weight between 2,000–8,000 and manufactured by Economics Laboratory was added to the first intermediate mixture to form a second intermediate mixture. The temperature of the second intermediate mixture rose to 195° F. due to a reaction between the sodium hydroxide and the polyacrylic acid. 2,019 lbs. of a 50 wt-% sodium hydroxide solution was slowly added to the second intermediate mixture with the resultant detergent emulsion at 120 r.p.m. The detergent emulsion was circulated through a Tekmar® processor for 90 minutes. Ninety minutes after processing a sample of the emulsion was tested in a Brookfield viscometer and found to have a viscosity of 420 cps at 100° F.

EXAMPLE II

Into a 5 gallon vessel equipped with a turbine propeller, a steam jacket and cooling water jacket was placed 7.2 lbs. of a copolymer of acrylic acid and itaconic acid having a molecular weight of approximately 10,000 and manufactured by Economics Laboratory, Inc., 4.6 lbs. of NPE 9.5, a nonylphenoxy ethoxylate having 9–10 moles of ethoxylate manufactured by Economics Laboratory, and 1.5 lbs. of soft water to form a first mixture. The first mixture was heated to 110° F. and mixed for 10 minutes. 2.23 lbs. of NPE 6.5, a nonylphenoxy ethoxylate having 6–7 moles of ethoxylate manufactured by Economics Laboratory, was added to the first mixture to form a second mixture. The second mixture was heated to 149° F. and agitated for 10 minutes. 0.029 lbs. Tinopal CBS-X, a distyryl biphenyl derivative useful as an optical brightener manufactured by Ciba-Geigy, was sprinkled into the second mixture under constant agitation to form a third mixture. The third mixture was agitated for 10 minutes. 0.036 lbs. of a 1 wt-% aqueous solution of Sandogran Blue 2GLS, a blue dye manufactured by Sandoz, was slowly added to the third mixture under constant agitation to form a pre-mix. The pre-mix was agitated for 10 minutes. The pre-mix was heated to a temperature of 135° F. 21 lbs. of a 50 wt-% sodium hydroxide solution was slowly added to the pre-mix under constant agitation to form a first intermediate mixture. 3.15 lbs. of a polyacrylic acid having a molecular weight of 2,000–8,000 and manufactured by Economics Laboratory, was pre-heated to 125° F. and added to the first intermediate mixture under constant agitation to form a second intermediate mixture. The second intermediate mixture was agitated for 15 minutes and reached a temperature of 190° F. due to an exothermic reaction between the sodium hydroxide and the polyacrylic acid at which time the cooling system was turned on to maintain the temperature below 190° F. 20.25 lbs. of a 50 wt-% sodium hydroxide solution was slowly added to the second intermediate mixture under constant agitation to form the detergent emulsion.

EXAMPLE III

A detergent emulsion was prepared in accordance with the procedure of Example I except that the emulsion was prepared in a 5 gallon vessel and the amount of each component was as follows:

| Component | Lbs. |
|---|---|
| First sodium hydroxide solution | 20.3 |
| Soft water | 1.74 |
| Acrylic acid/itaconic acid copolymer | 6.96 |
| NPE 9.5 | 4.45 |
| NPE 6.5 | 2.16 |
| Tinopal CBS-X | 0.28 |
| SANDOGRAN BLUE (1 wt-% solution) | 0.70 |
| Polyacrylic acid | 3.48 |
| Second sodium hydroxide solution | 18.56 |

EXAMPLE IV

A detergent emulsion was formed in accordance with the procedure of Example I except that 300 lbs. polyacrylic acid, 120 lbs. soft water, and 2,096 lbs. second sodium hydroxide solution were employed.

EXAMPLE V

The detergent emulsion formed in Example III was pumped through a single roller 90 r.p.m. peristaltic pump having a ¼" I.D. and ½" O.D. EPDM squeeze tube. Flow rates for the emulsion are presented below.

| Product Temperature | Flow Rate |
|---|---|
| 40° F. | 140 ml/min. |
| 50° F. | 285 ml/min. |
| 70° F. | 320–330 ml/min. |

EXAMPLE VI 18 samples of the detergent emulsion prepared in Example IV were tested in a Brookfield viscometer resulting in an average viscosity of 352 centipoise at 70° F. with a standard deviation of 2.906 cps. The rest Brookfield viscosity was then measured for the detergent emulsion after 1 day, 2 days, 2 weeks, and 6 weeks resulting in viscosities of 470 cp, 480 cp, 560 cp, and 618 cp at 70° F. respectively.

I claim:

1. A method of manufacturing a storage stable, phosphorous-free caustic detergent emulsion, comprising the steps of:

(a) blending:

(i) about 0.1 to 10 wt-% phosphorous-free hardness sequestering polyelectrolyte comprising a polycarboxylate polymer, (ii) about 5 to 40 wt-% nonionic surfactant, and (iii) about 1 to 10 wt-% water, based upon the emulsion, to form a pre-mix;

(b) blending about 5 to 60 wt-%, based upon the emulsion, of a 40 to 60 wt-% first caustic solution and the pre-mix to form a first intermediate mixture;

(c) blending a viscosity modifying and emulsion stabilizing amount of an acrylic resin and the first intermediate mixture to form a second intermediate mixture;

(d) blending about 10 to 50 wt-%, based upon the emulsion, of a 40 to 60 wt-% second caustic solution and the second intermediate mixture to form the emulsion having a viscosity of about 250 to 1000 cp at 70° F.

2. The method of claim 1 further comprising the step of blending an additive selected from the group consisting of an optical brightener, a dye and mixtures thereof, into the pre-mix.

3. The method of claim 1 wherein the pre-mix and the first caustic solution are blended by adding the pre-mix to the first caustic solution under agitation.

4. The method of claim 1 wherein the pre-mix and the first caustic solution are blended by adding the first caustic solution to the pre-mix under agitation.

5. The method of claim 1 wherein the pre-mix, first intermediate mixture, second intermediate mixture and emulsion are heated to about 100° to 160° F. and maintained at that temperature throughout the method.

6. The method of claim 1 wherein the first caustic solution is heated to a temperature between about 100° to 160° F. before it is blended with the pre-mix.

7. The method of claim 6 further comprising the steps of heating the pre-mix, the acrylic resin and the second caustic solution to a temperature between about 100° to 150° F. before blending each.

8. The method of claim 1 wherein the first and second caustic solutions comprise the same caustic material at substantially the same concentration, and the caustic material is selected from the group consisting of alkali metal hydroxides, alkali metal silicates and alkali metal carbonates.

9. The method of claim 8 wherein the caustic material comprises an alkali metal hydroxide.

10. The method of claim 8 wherein the first and second caustic solutions comprise about 40 to 60 wt-% caustic material and the emulsion comprises about 25 to 45 wt-% first caustic solution and about 30 to 40 wt-% second caustic solution based upon the emulsion.

11. The method of claim 1 wherein the polyelectrolyte comprises an organic hardness sequestering polymer having pendent carboxyl groups.

12. The method of claim 11 wherein the polyelectrolyte comprises a copolymer of acrylic acid and itaconic acid having a molecular weight between about 5,000 to 15,000.

13. The method of claim 1 wherein the nonionic surfactant is selected from the group consisting of ethoxylated nonylphenols, ethoxylated linear alcohols and mixtures thereof.

14. The method of claim 1 wherein the nonionic surfactant comprises a mixture of ethoxylated nonylphenols having 6–10 moles of ethoxylate.

15. The method of claim 14 wherein the pre-mix comprises (i) about 4 to 8 wt-% acrylic acid-itaconic acid copolymer having a molecular weight between about 5,000 to 15,000 (ii) about 10 to 15 wt-% of a mixture of ethoxylated nonylphenols having 6–10 moles of ethoxylate, and (iii) about 6 to 10 wt-% water based upon the emulsion.

16. The method of claim 1 wherein the acrylic resin comprises polyacrylic acid and the emulsion comprises about 1.5 to 3.5 parts polyacrylic acid.

17. A method of manufacturing a storage stable, phosphorous-free detergent emulsion comprising the steps of:

(a) heating about 25 to 45 wt-%, based upon the emulsion, of a 40 to 60 wt-% first sodium hydroxide solution to about 100° to 160° F.;

(b) blending:

(i) about 4 to 8 wt-% acrylic acid-itaconic acid polymer having a molecular weight between about 5,000 to 15,000, (ii) about 10 to 15 wt-% ethoxylated nonylphenols having 6–10 moles of ethoxylate, and (iii) about 6 to 10 wt-% water, based upon the emulsion, to form a pre-mix;

(c) blending the first sodium hydroxide solution and the pre-mix to form a first intermediate mixture;

(d) blending about 1.5 to 3.5 wt-%, based upon the emulsion, acrylic resin and the first intermediate mixture to form a second intermediate mixture;

(e) blending about 30 to 40 wt-%, based upon the emulsion, of a 40 to 60 wt-% second sodium hydroxide solution to the second intermediate mixture to form an emulsion having a viscosity of about 250 to 1000 cps at 70° F.; and (f) vigorously agitating the emulsion under high shear.

18. The method of claim 17 wherein the pre-mix and the first sodium hydroxide solution are blended by adding the first sodium hydroxide solution to the pre-mix under constant agitation.

19. The method of claim 17 wherein the pre-mix and the first caustic solution are blended by adding the pre-mix to the first sodium hydroxide solution under constant agitation.

20. The method of claim 17 further comprising the step of blending at least one additive selected from the group consisting of optical brighteners, dyes and mixtures thereof into the pre-mix.

* * * * *